US005194292A

United States Patent [19]

Billings

[11] Patent Number: 5,194,292

[45] Date of Patent: Mar. 16, 1993

[54] METHOD OF DRYING AND BONDING NAIL POLISH

[76] Inventor: Calvert W. Billings, 23221 Peralta, Suite H, Laguna Hills, Calif. 92653

[21] Appl. No.: 806,360

[22] Filed: Dec. 13, 1991

[51] Int. Cl.[5] ..... B05D 3/06

[52] U.S. Cl. ..... 427/493; 427/323; 427/389; 427/412.1; 427/514; 427/508

[58] Field of Search ..... 427/53.1, 54.1, 323, 427/389, 412.1

*Primary Examiner*—Bernard Pianalto

*Attorney, Agent, or Firm*—Francis X. LoJacono

[57] ABSTRACT

The present invention provides a method of drying and bonding one or more layers of nail polish the the surface of a fingernail, wherein the final coating is defined as a photo-sensitive material that is activated by means of a photo-active light source.

5 Claims, No Drawings

METHOD OF DRYING AND BONDING NAIL POLISH

BACKGROUND OF THE INVENTION

1. Field of the Invention

The present invention relates generally to a method of drying and bonding nail polish, and more particularly to the bonding of nail polish on a fingernail by means of a photo-sensitive protective top coat that is photo activated by either an ultra-violet light or by a natural incandescent light source.

2. Description of the Prior Art

Many problems and difficulties often occur in the application and treating nail polish. Two of the most prevailing problems, however, are in the drying of the various layers or coatings after one or more coating have been applied to the fingernail. The other problem consist of properly bonding a final finished protective clear coat. After the application of one or more polish costs have been applied to a fingernail they are often not completely dry to a point wherein the solvents that help form the nail polish are not completely released from the polish before a protective coat is applied. Some methods of treating nail polish use a heat source along which will dry the nail polish but does not cause a good bonding between the nail polish. The polish looks dry but is sometimes left tacky which allows the polish to open to smudging. Yet, if the polish is overly dry it becomes susceptible to chipping and cracking. When more than one coat of nail polish is used is covered with a photo-sensitive top coat, which does not dry the polish, only the very top layer of the polish is provided with a bonding affect. This arrangement causes the remaining solvents in the various layer of nail polish to be trapped below the photo-sensitive top coat. This in turn causes a slow and uneven drying of one or more of the polish coats to take place. Accordingly, the slow and uneven drying will often result in poor adhesion to the nail, wherein the resultant nail polish becomes susceptible to cracking as well as chipping.

However, from the following description of the present invention it will be readily understood how the problems as mentioned above can be overcome by the by employing the method as will hereinafter be claimed.

OBJECTS AND ADVANTAGES OF THE INVENTION

The preferred form of the present invention in to provide a simple but unique method of drying and bonding nail polish when applied to a fingernail. The application of the polish can be either applied as a single layer or in multiple layers. After the drying of the layer or layers of nail polish, the upper layer is then coated with a final layer of a top protective coat of photo-sensitive material that is either photo activated by means of an ultra-violet light or by a material that is activated by means of a suitable incandescent light means.

Accordingly, it is an important object of the present invention to provide a simple method that will readily allow trained or non-trained individuals to successfully apply one or more nail polish coatings to one's fingernails and then protect the layers from smudging, chipping and/or cracking by applying a finish bonding layer using a photo-sensitive material as a top coat.

Another object of the invention as presented herein provides for the use of one of two types of photo-sensitive material, wherein one type is photo activated by means of an ultra-light source and the other type is photo-sensitive by an incandescent light means.

Still another object of the invention is to provide a method of this character the includes the steps of:

- applying a base coat to the fingernail for protection;
- applying one or more polish coats on top of the dried base coats;
- applying a photo-sensitive coating which is adapted to be photo activated by either an ultra-violet light source or by an incandescent light source;
- drying all of the layers of polish using a heating source to allow the release of the solvents that might remain in the various layers of the nail polish.

After removal from the heat source the coated nails are then placed under an ultra-violet light source or an incandescent light source that corresponds to the final protective coat that is specifically used.

A further object of the present invention is to provide a fingernail polishing method that will also enhance the finished glossy look of the fingernail as well as to protect the polish from chipping and cracking. Thus, when the present method is employed the life of the polish will be extended before it has to be removed.

A still further object of the invention is to provide a fingernail polishing method of drying and bonding nail polish to a fingernail wherein the heat drying and the exposure to the activating light source can be accomplished together, that is at the same time.

The foregoing is a description of several preferred embodiments of the invention which are given here by way of example only. The invention is not to be taken as limited to any of the specific features as described, but comprehends all such variations thereof as come within the scope of the appended claims.

DETAILED DESCRIPTION OF THE INVENTION

Referring now to the preferred method of the present invention which will hereinafter be defined as having several arrangements of steps that are to be followed to practice and accomplished the proper drying and bonding of nail polish to one's fingernails.

The first step is well understood and that is to prepare the fingernail by cleaning the surface from any and all foreign material such as might be left over from the previous nail polish coatings or any dirt or removing any oily film that might interfere with the bonding the base layer of nail polish to the surface of the nail. Once this is done then the steps of present new method can begin. That is, one applies a base coat of nail polish to the immediate free, clean surface of the nail of the first finger. This step is continuously followed for each of the remaining nine fingers. Thus, by the time all of the ten fingernails receive their first protective base coat, the preceding first coats should be dried sufficiently to except the following second coat of nail polish. However, it should be noted that in some applications more than two coats of nail polish can be used. Again, when all of the fingernails have been provided with their one or more layers of polish a final top coat of polish is then applied which defines the finish glossy coat of the nail.

At this time a final top coat is applied which consist of a photo-sensitive material which defines the major bonding layer of the process. Even though all of the layers of polish are dry enough to apply the last photo-sensitive coating, it is important to note that not all of the solvent material has been completely released from some of the preceding layers of polish.

All of the coated fingernails are subjected to a suitable heat source such as a hot air dryer which is commonly employed to allow for the complete release of the solvents remaining in the layers of polish. After removing the heat treated nails they are then exposed to an photo activating means. The type of photo activating means depends on the type of photo-sensitive material that is used. At present the preferred form of photo-sensitive material would be of the type that reacts to the exposure of an ultra-violet light. A second photo-sensitive material can be employed, wherein it is readily photo activated by exposing the coated nails to direct incandescent lighting from any suitable light means. Both forms of the photo-sensitive material will cause the top protective coat to become polymerized, that is, cured or hardened wherein the layers of nail polish are bonded whereby a protective covering is established which prevents chipping, scratching and smudging.

It is further contemplated that the drying by heat and the polymerizing of the final protective coat can be accomplished simultaneously if a single unit is provided that includes a heating means and one of the above required light sources.

It may thus be seen that the objects of the present invention set forth herein, as well as those made apparent from the foregoing description, are efficiently attained. While preferred embodiments of the invention have been set forth for purpose of disclosure, modification of the disclosed embodiments of the invention as well as other embodiments thereof may occur to those skilled in the art. Accordingly, the appended claims are intended to cover all embodiments which do not depart from the spirit and scope of the invention.

What I claim is:

1. A method for drying and bonding nail polish to a fingernail, wherein the steps thereof comprises:

cleaning the surface of a fingernail to be coated with nail polish;

applying at least one coat of nail polish to the surface to the fingernail;

applying a final top coat of photo-sensitive material;

drying the nail polish by means of applying heat thereto so as to release any remaining solvents therein; and exposing the photo-sensitive material to a respective photo-active light source so as to activate the material, whereby the photo-sensitive material is polymerized, thereby bonding the nail polish to the surface of the fingernail so as to prevent chipping, scratching and smudging.

2. The method as recited in claim 1, wherein more than one coat of nail polish is layered over the fingernail and wherein the first coat of nail polish defines a base coat over which the remaining coats are layered and bonded to the surface of the fingernail when the photo-sensitive material is polymerized.

3. The method as recited in claim 2, wherein said photo-sensitive material is formed to be photo activated by an ultra-violet light means.

4. The method as recited in claim 2, wherein said photo-sensitive material is formed to be photo activated by an incandescent light means.

5. The method as recited in claim 2, including the step of allowing all of the layers of nail polish to sufficiently dry before applying a final protective coat.

* * * * *